US008267144B2

(12) United States Patent
Hsu et al.

(10) Patent No.: US 8,267,144 B2
(45) Date of Patent: Sep. 18, 2012

(54) ROMAN SHADE WINDOW CURTAIN HAVING A SPECIAL HEAD RAIL FOR USING A ROLLER SHADE AS ITS RELEASE/RETRACTION CONTROL

(75) Inventors: Kai-Sheng Hsu, Walnut, CA (US); Chih Yung Wang, Taipei (TW)

(73) Assignee: Pacific Heritage Home Fashions Inc., Walnut, CA (US)

( * ) Notice: Subject to any disclaimer, the term of this patent is extended or adjusted under 35 U.S.C. 154(b) by 241 days.

(21) Appl. No.: 12/564,806

(22) Filed: Sep. 22, 2009

(65) Prior Publication Data

US 2011/0067820 A1 Mar. 24, 2011

(51) Int. Cl.
*E06B 3/48* (2006.01)

(52) U.S. Cl. ..... 160/84.01; 160/84.04; 160/264

(58) Field of Classification Search ..... 160/84.04, 160/84.01, 84.03, 348, 264, 270, 269
See application file for complete search history.

(56) References Cited

U.S. PATENT DOCUMENTS

| | | | | |
|---|---|---|---|---|
| 5,273,096 | A * | 12/1993 | Thomsen et al. | 160/84.01 |
| 5,690,156 | A * | 11/1997 | Ruggles | 160/84.04 |
| 5,862,850 | A * | 1/1999 | Yang | 160/84.04 |
| 6,257,300 | B1 * | 7/2001 | Brownlie | 160/84.01 |
| 6,497,264 | B1 * | 12/2002 | Paskevicius | 160/84.04 |
| 6,817,399 | B2 * | 11/2004 | Berman et al. | 160/84.04 |
| 6,854,500 | B2 * | 2/2005 | Chen et al. | 160/84.01 |
| 7,117,917 | B2 * | 10/2006 | Allsopp | 160/84.04 |
| 7,124,801 | B2 * | 10/2006 | Ng et al. | 160/84.04 |
| 7,673,665 | B2 * | 3/2010 | Rossato | 160/84.01 |
| 7,975,747 | B2 * | 7/2011 | Liang et al. | 160/84.04 |
| 2005/0269040 | A1 * | 12/2005 | Nien | 160/84.01 |
| 2006/0096716 | A1 * | 5/2006 | Yu et al. | 160/84.04 |
| 2006/0157204 | A1 * | 7/2006 | Lin | 160/84.04 |
| 2007/0000619 | A1 * | 1/2007 | Ng et al. | 160/84.04 |
| 2007/0235147 | A1 * | 10/2007 | Zakowski et al. | 160/84.04 |
| 2007/0251652 | A1 * | 11/2007 | Anthony et al. | 160/84.04 |
| 2008/0295975 | A1 * | 12/2008 | Lin | 160/84.04 |
| 2010/0147468 | A1 * | 6/2010 | Liang et al. | 160/84.04 |
| 2010/0186903 | A1 * | 7/2010 | Liang et al. | 160/84.01 |
| 2010/0294438 | A1 * | 11/2010 | Kirby et al. | 160/84.04 |
| 2011/0048652 | A1 * | 3/2011 | Chen | 160/84.04 |
| 2011/0073260 | A1 * | 3/2011 | Kollman et al. | 160/84.04 |
| 2011/0162806 | A1 * | 7/2011 | Lin | 160/84.04 |

OTHER PUBLICATIONS

Definition of "Valance" The American Heritage® Dictionary of the English Language, Fourth Edition copyright © 2000 by Houghton Mifflin Company. Updated in 2009. Published by Houghton Mifflin Company. All rights reserved. http://www.thefreedictionary.com/Valance.*

* cited by examiner

*Primary Examiner* — Katherine W Mitchell
*Assistant Examiner* — Johnnie A Shablack
(74) *Attorney, Agent, or Firm* — Jen-Feng Lee, Esq.

(57) ABSTRACT

Present invention teaches to build a Roman shade window curtain where a roller shade is used in the back side of said window curtain, to provide for the release/retraction control, resulting in a "cord-less" control for the actuation of a Roman shade, which hangs down from a special head rail on top, with the roller shade fabrics slideably travel down the gaps between each horizontal fold created by the rib, clip and rib rod.

5 Claims, 7 Drawing Sheets

ROMAN SHADE WINDOW CURTAIN HAVING A SPECIAL HEAD RAIL FOR USING A ROLLER SHADE AS ITS RELEASE/RETRACTION CONTROL

FIELD AND BACKGROUND OF THE INVENTION

The present invention relates generally to window curtains containing a Roman shade, using a functional Roller shade for automatic release/retract of the Roman shade.

Window curtains are made for functional usages of blocking sunlight, or creating privacy, and for decorative purpose of adding visual attractiveness to households. Depending on consumers' liking and preferences, quite a number of styles and variation of window curtains/shades are commercially available. Traditional fabric curtains, plastic or wood mini-blinds, Roman shades, vertical blinds, etc, are all the commonly seen choices.

A traditional Roman shade typically consists of a head rail or track system, a semi-automatic or manual cord lift mechanism that is used to actuate the spring-loaded release/retract device attached to the head rail, and several pleats, or folds, created at regular intervals along the vertical length of the shade. These cord-based systems presented a danger to children, though consumers continue to desire the decorative nature of a Roman shade.

By combining a roller shade with a Roman shade, the present invention is inherently free of cords and thus removes the danger associated with the cord. The control for the release and retraction of the Roman shade is accomplished by the Roller shade that is hidden behind, thus making the window curtain a safe device with the desired Roman shade decorative features.

OBJECTS AND SUMMARY OF THE INVENTION

Present invention teaches to build a Roman shade window curtain where a roller shade is used to provide for the release/retraction control for the window curtain, resulting in a "cordless" control for the actuation of a Roman shade.

Another objective of present invention is to provide a Roman shade system that can be operated by roller shade using a chain driven clutch mechanism if such is desired. When using this type of control mechanism, a "tie down" device can be used to secure the chain, thus addressing the safety hazard.

It is a further objective of present invention to provide a Roman shade system that can be operated by a roller shade using a motorized lift system, thus controlling the shade via electronic or remote control means.

It is yet a further objective of present invention to provide a Roman shade system that offers flexibility in light control by making it possible to use the myriad of fabrics with varying degrees of light control or opaqueness available in the industry. If the user wishes to have a Roman shade with room darkening or blackout properties, the roller shade portion of this invention can be made with such fabric while still allowing the user to select a more decorative yet less opaque fabric for the Roman shade portion of the complete window curtain.

A still further objective of present invention is to provide a Roman shade that can be operated using a semi-automatic or spring assist control mechanism within the roller shade portion of the completed shade.

DESCRIPTION OF THE DRAWINGS

The accompanying drawings, which are incorporated in and constitute a part of this specification, illustrate the preferred embodiments of the invention and together with the description, serve to explain the principles of the invention.

A brief description of the drawings is as follows.

DETAILED DESCRIPTION OF THE PREFERRED EMBODIMENT

Figure 1:
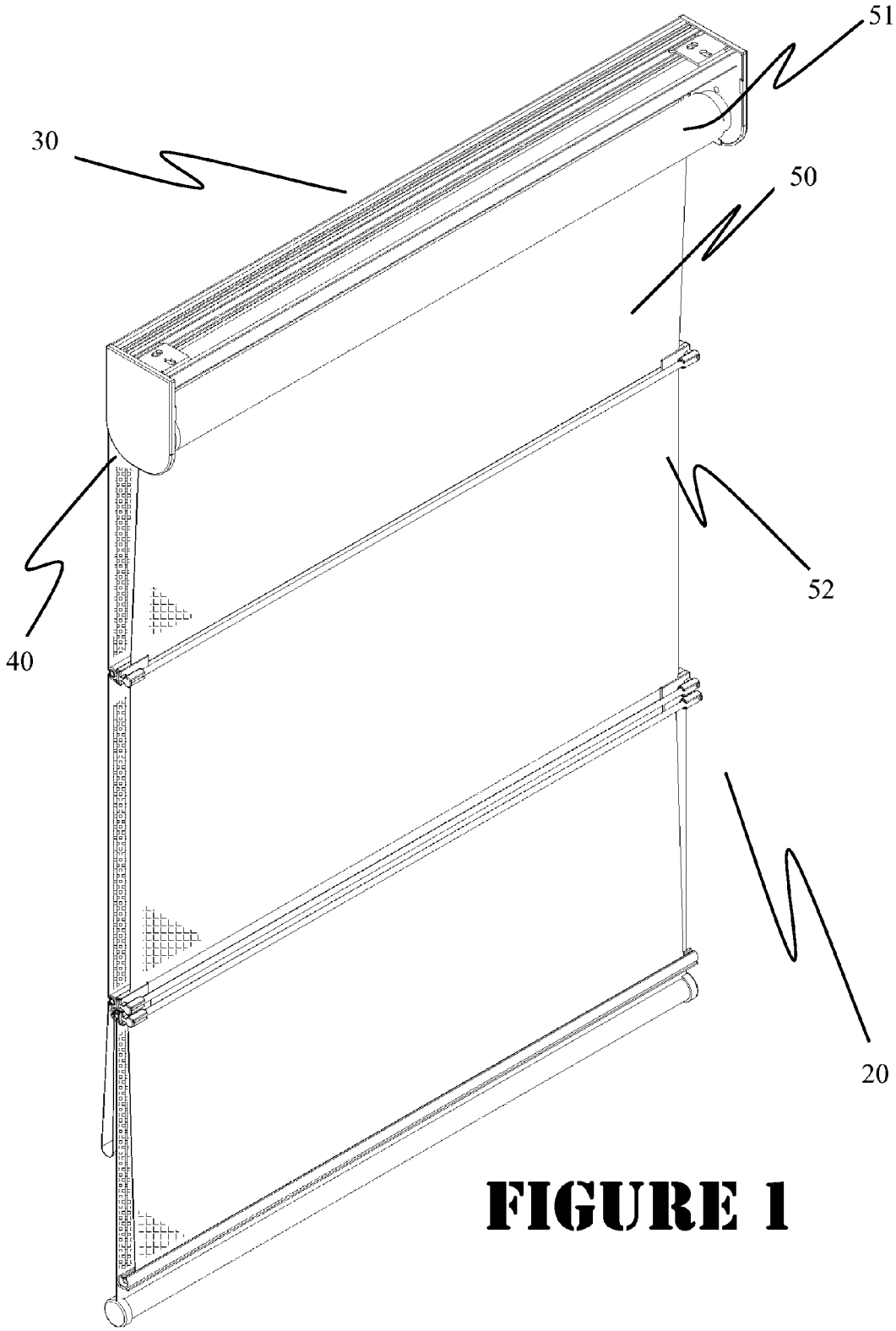
FIG. 1 shows an overall perspective of a window curtain made pursuant to the disclosure herein. The back side of the curtain is showing, where the roller shade is used to provide for the release/retraction control.

As shown herein, the preferred embodiment of the present invention includes a window curtain 20 that is a combination of a functional Roller shade 50, in all of its accepted forms with a Roman shade 40 fascia or front. Said Roman shade 40 is mounted to the Roller shade 50 by using a special Head rail 30, made of aluminum extrusion, designed to be mounted to the wall over a window opening or within the window frame; these mounting options are referred to as inside or outside mount.

There is no technical disclosure required herein to teach the construction of a functional roller shade 50. For purpose of better description, however, the roller portion will be referred to by number 51, and the roller shade fabric that drapes down will be referred to by number 52.

This aluminum extrusion special head rail 30 has a horizontal channel structure that contains a forward-facing opening 36 to receive the top portion of said Roman shade 40, creating a valance to cover the head rail 30. Alternatively, the opening 36 can also be made to face upward, for purpose of receiving the top portion of said Roman shade 40, to create a valance.

Figure 4:
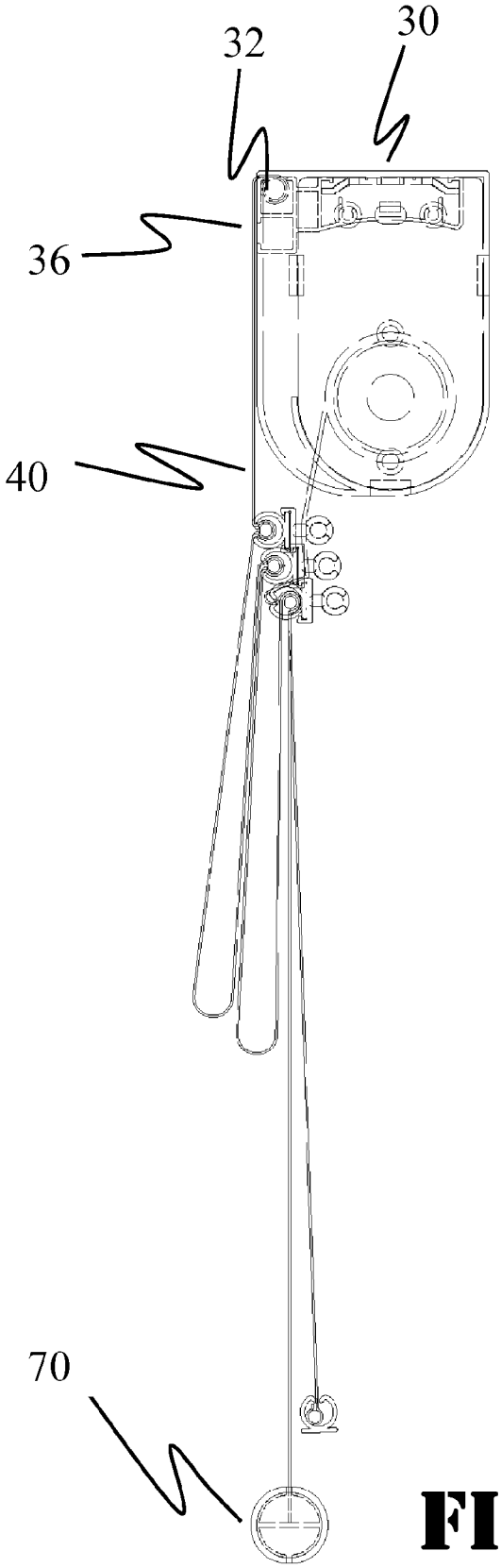
FIG. 4 shows the side view of the window curtain of present invention in a retracted state.
Figure 5:
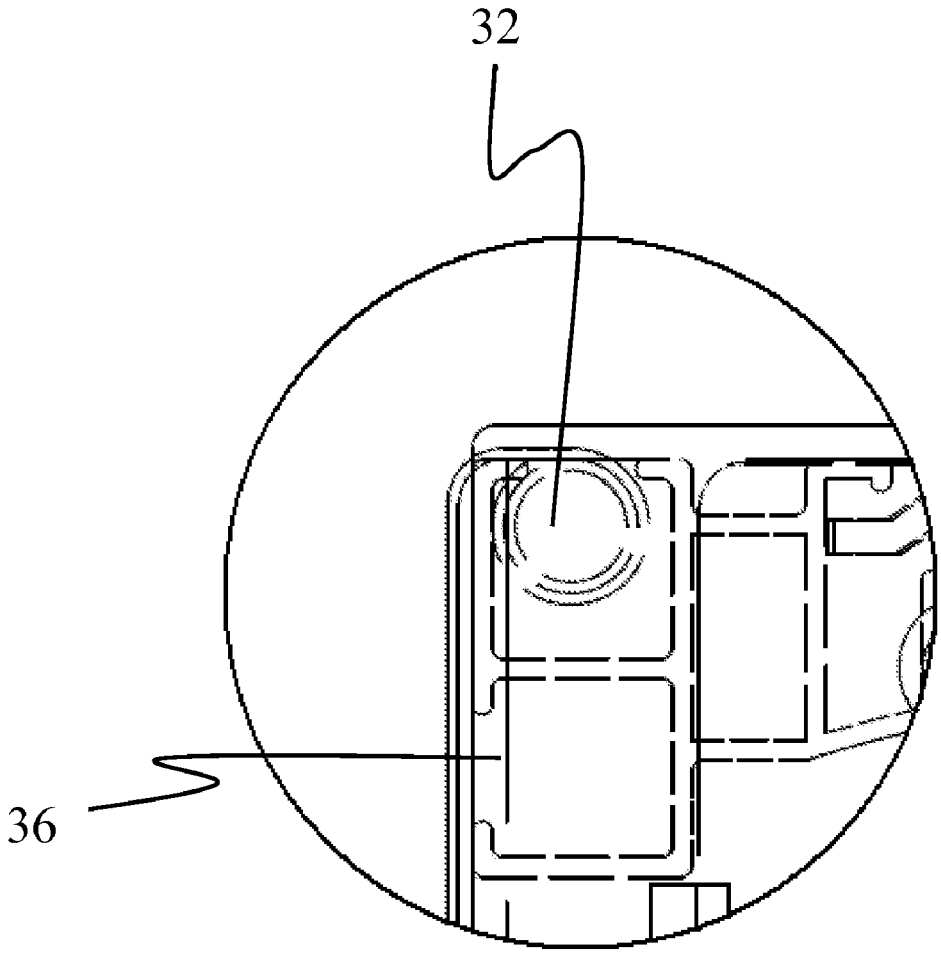
FIG. 5 shows the side view for the enlarged portion of the head rail where the top portion of said Roman shade extends out from the top opening of the head rail.

The top portion of said Roman shade 40 is held in the opening 36, either forward-facing or upward-facing, by a top inner rod 32, as shown in FIG. 4. The top inner rod 32 is of varying thicknesses to accommodate the varying thickness of shade fabrics.

A plurality of "folds" on the Roman Shade 40 is made by placing an inner rod 64 against the front surface of Roman shade 40 horizontally into a rib 65, which is generally in the shape of a horizontal tube with an opening to receive said inner rod 64 along with the "fold" of the Roman shade 40.

Figure 2:
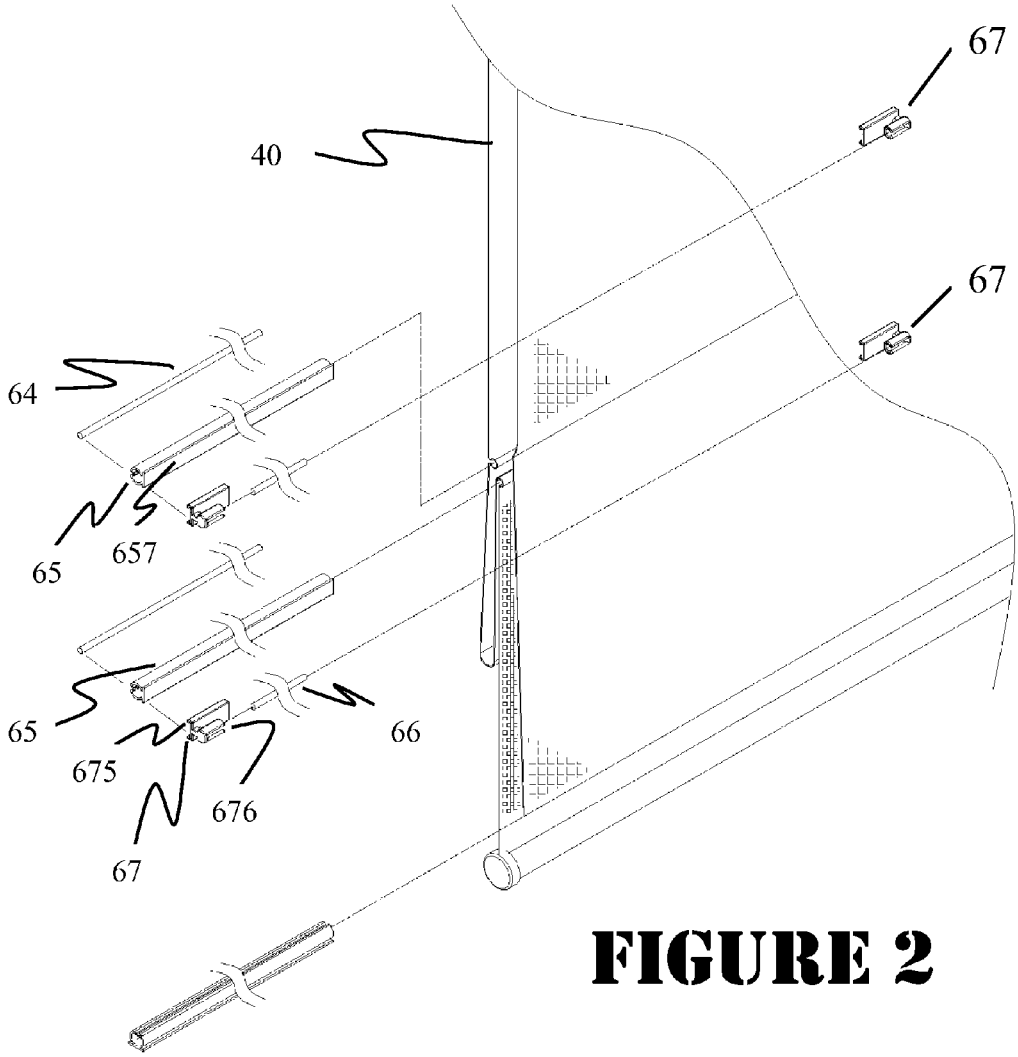
FIG. 2 shows the partial exploded view of present invention, detailing the gaps created by the rib, clip and rib rod structures used on the horizontal folds of the Roman shade.
Figure 3:
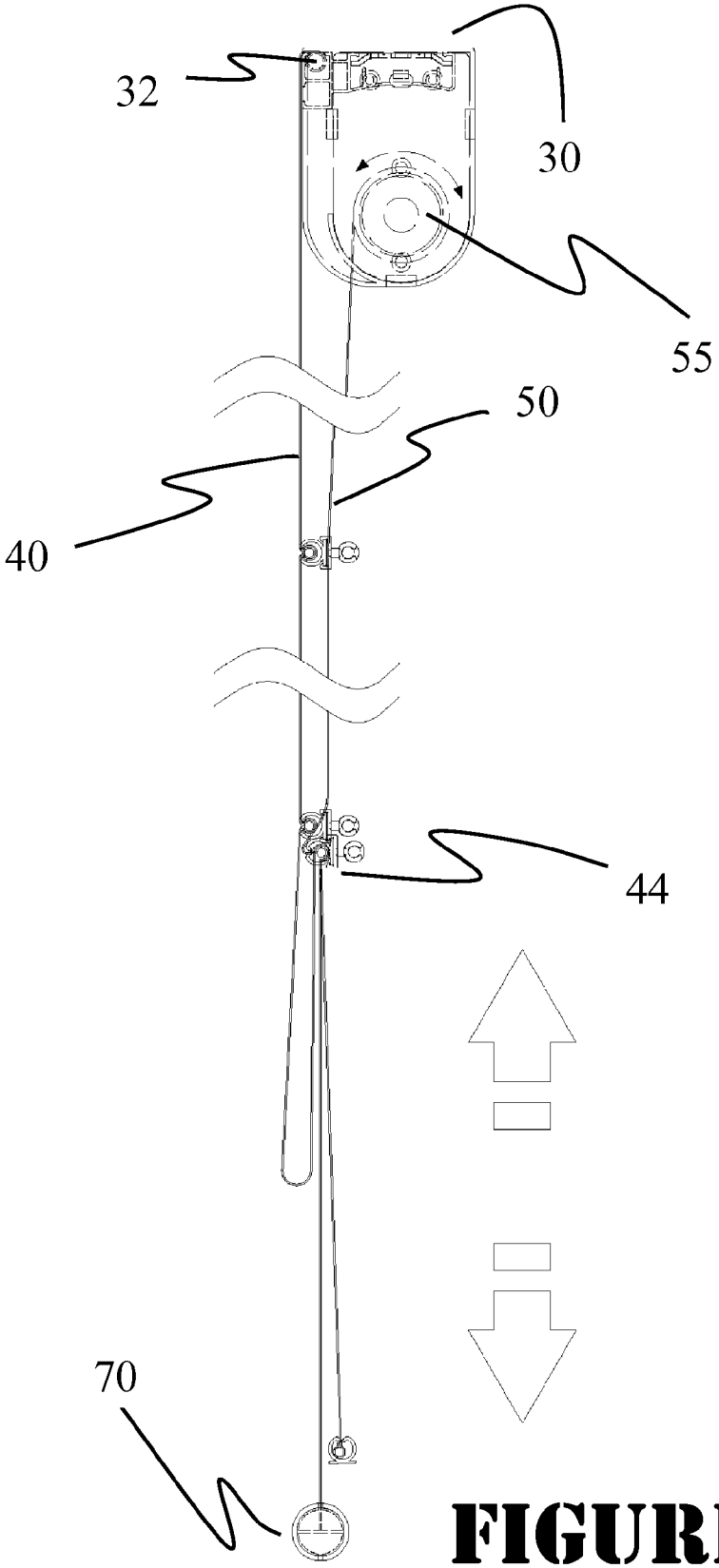
FIG. 3 shows the special head rail and the opening on the special head rail to receive the top portion of said Roman shade.

Said rib 65 has a back-fin 657 portion made to correspond to a claw 675 portion of a clip 67, which has a channel opening 676 to receive a rib rob 66, as shown in FIG. 2 and FIG. 3. Said clip 67 is used on the left and right ends of each rib 65 and rib rod 66.

When the clip 67 is reversed, it can be used on either left or right end of each rib, as shown in FIG. 2.

As such, at each "fold" position, the functional Roller Shade 50 is able to slideably move up and down in the narrow vertical gap 426 created by the space between said rib rod 66 and rib 65.

At the bottom-most "fold" of the Roman Shade 40, the part of the Roller Shade 50 is horizontally joined to the Roman Shade 40 (either by a rib 65 or any other mechanism to fix the two fabrics together), creating a position setting device 44, where this mutual contact generates the lifting motion required to raise or lower the Roman shade 40.

A bottom rail 70 in any of its current forms is then attached to the lower edge of the Roman shade 40 fabric, giving it a finished or decorative appearance. This bottom rail 70 is also considered functional in that it provides a hand hold for the user to tug on to release the brake mechanism of spring assist control systems that's part of the Roller Shade release/retract mechanism.

When a wide shade is required, the system can be made to have one single or continuous piece of fabric comprising the Roman shade 40 portion of the shade, while having two separate pieces of Roller shade 50 mounted to the roller tube 55 on top.

This is accomplished by using a center rib clip 6776 that acts as connector for the two Roller Shades 50, for purpose of both Roller shades 50 sliding up and down the gap 426 created by the rib 65 and rib rod 66.

Figure 6:
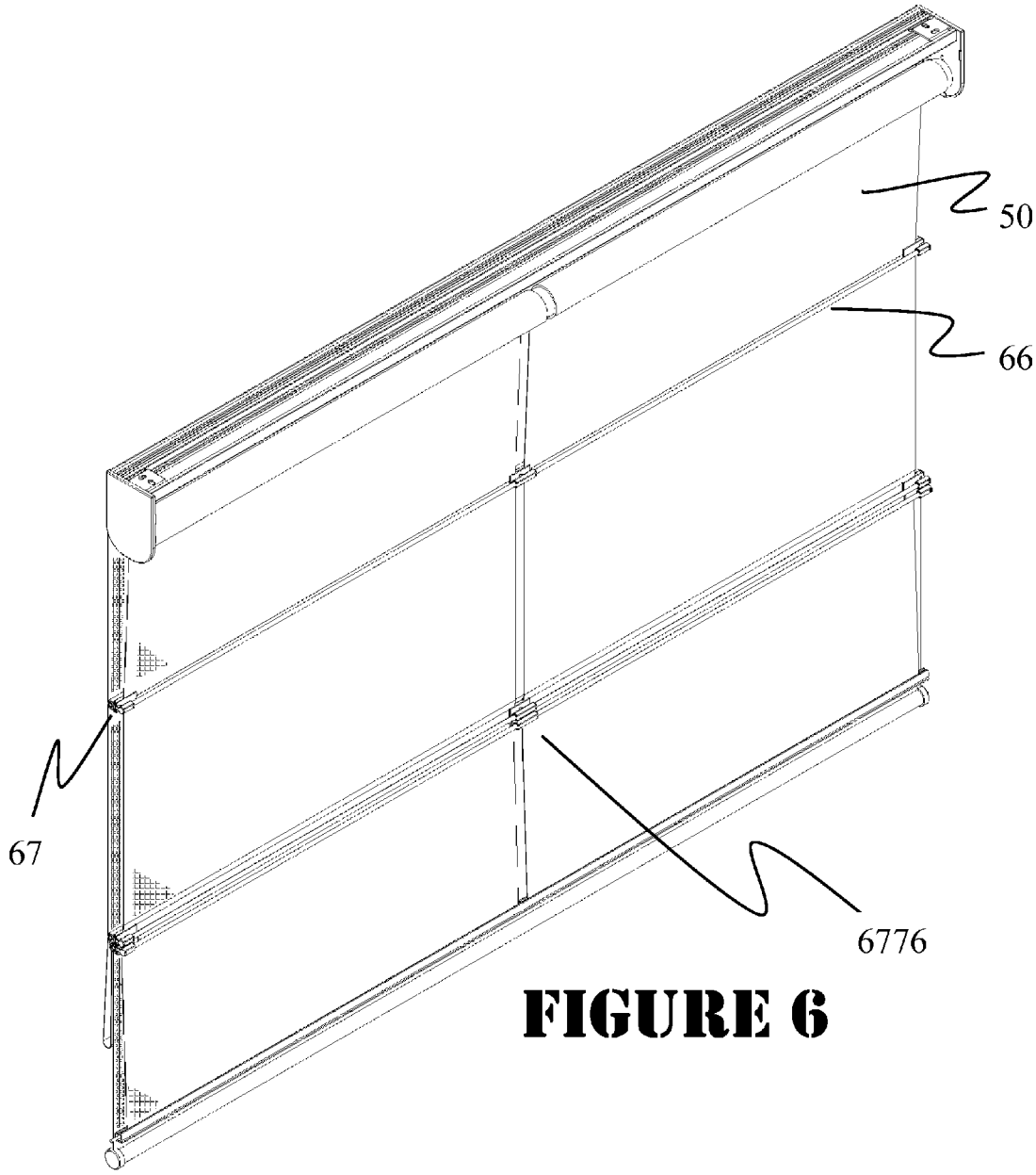
FIG. 6 shows the overall view of a window curtain with a 2-piece roller shade construction.
Figure 7:
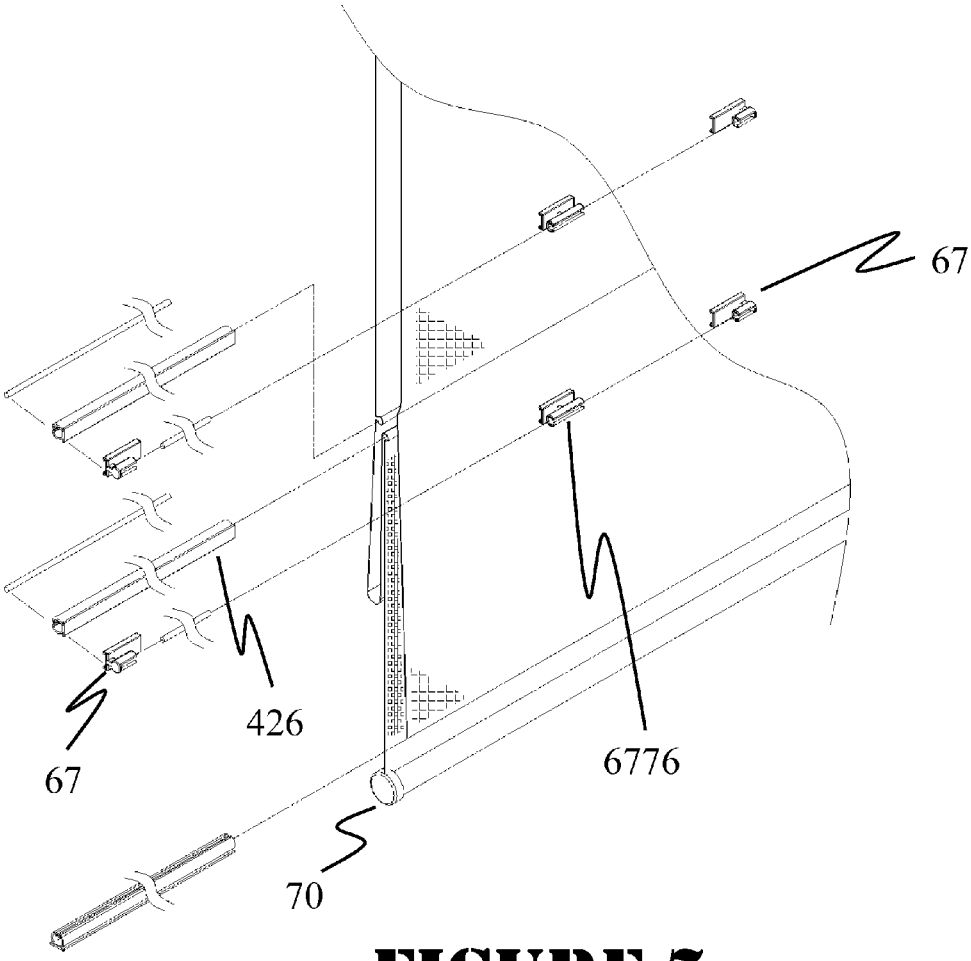
FIG. 7 shows the 2-piece roller shade construction, with partial exploded view on the rib and rib rod connection in relation to the center clip

To create a wide Roman shade window curtain, it can be done by following the same teaching above, and find the middle point at each fold position, and use the center rib clip 6776 to receive the left rib 64 and the left rib rod 66 and to receive the right rib 65 and right rib rod 66, as shown on FIG. 6.

The 2-piece construction can be applied to more than 2 pieces construction and it requires no further disclosure herein, since the same rib 65, rib rod 66, clip 67 with claw 675 to clamp to the back-fin 657 of said rib are all the same.

The bottom rail 70 remains the same construction in the two-piece Roller shade 50 construction for wide shade application.

What is claimed is:

1. A Roman shade window curtain having a Roller shade as the release and retraction control means, comprising:

a. A roller shade;

b. A Roman shade;

c. An aluminum extrusion special head rail on the top of said roller shade where an opening is made to receive the top portion of said Roman shade, with a top inner rod being used to keep the top portion of said Roman shade inside said opening, creating a valance;

d. A plurality of inner rods to create folds on said Roman shade where a plurality of ribs are horizontally positioned to receive said plurality of inner rods and clamp a length of Roman shade fabric in place;

e. A pair of clips situated near the left and right ends of each rib to receive a horizontal rib rod corresponding to each rib, so that said roller shade fabric is placed vertically and slideably through a gap created between said rib and rib rod;

f. A position-setting device where the two fabrics from said Roman shade and said Roller shade are joined together below the lowest fold created by the inner rods; and, g. A bottom rail to receive the lower end of said Roman shade and serve as a pull and tug point for release and retraction of the window curtain of present invention.

2. The window curtain of claim 1, wherein each of said rib further comprising an open trough for receiving each of said inner rod and a back-fin, and wherein each of said clip further comprising a claw sized to grab onto said back-fin of said rib and a channel opening sized to receive said rib rod.

3. The window curtain of claim 2, where said opening on the special head rail is made to be forward-facing.

4. The window curtain of claim 2, where said opening on the special head rail is made to be upward-facing.

5. The window curtain of claim 2, wherein said roller shade is a 2-piece construction, so that a center clip is added to the horizontal middle point of any fold position that is used to receive both the left rib, left rib rod and right rib, right rib rod.

* * * * *